US009417589B2

(12) United States Patent
Kubota et al.

(10) Patent No.: US 9,417,589 B2
(45) Date of Patent: Aug. 16, 2016

(54) SHEET PUNCHING DEVICE, SHEET PROCESSING DEVICE PROVIDED WITH THE SAME, AND IMAGE FORMING DEVICE

(71) Applicants: Ichitaro Kubota, Yamanashi-ken (JP); Eiji Fukasawa, Yamanashi-ken (JP); Hisashi Osada, Yamanashi-ken (JP); Takahiro Nakano, Yamanashi-ken (JP); Takuma Kobayashi, Yamanashi-ken (JP)

(72) Inventors: Ichitaro Kubota, Yamanashi-ken (JP); Eiji Fukasawa, Yamanashi-ken (JP); Hisashi Osada, Yamanashi-ken (JP); Takahiro Nakano, Yamanashi-ken (JP); Takuma Kobayashi, Yamanashi-ken (JP)

(73) Assignee: NISCA CORPORATION, Minamikoma-Gun, Yamanashi-Ken (JP)

( * ) Notice: Subject to any disclaimer, the term of this patent is extended or adjusted under 35 U.S.C. 154(b) by 0 days.

(21) Appl. No.: 14/690,893

(22) Filed: Apr. 20, 2015

(65) Prior Publication Data

US 2015/0309464 A1 Oct. 29, 2015

(30) Foreign Application Priority Data

Apr. 29, 2014 (JP) ..... 2014-093238
Apr. 29, 2014 (JP) ..... 2014-093239

(51) Int. Cl.

| | |
|---|---|
| ***B26F 1/04*** | (2006.01) |
| ***B26D 7/18*** | (2006.01) |
| ***G03G 15/00*** | (2006.01) |
| ***B26F 1/02*** | (2006.01) |

(52) U.S. Cl.

CPC ..... *G03G 15/6582* (2013.01); *B26D 7/1818* (2013.01); *B26F 1/02* (2013.01); *B65H 2408/12* (2013.01); *G03G 2215/00814* (2013.01)

(58) Field of Classification Search

CPC ..... B65H 35/006; B26F 1/02; B26F 1/14; B26F 1/04; B26D 7/1818; G03G 15/6582; Y10T 83/2131; Y10T 83/2168; Y10T 83/2127; Y10T 83/2122

See application file for complete search history.

(56) References Cited

U.S. PATENT DOCUMENTS

| | | | | | |
|---|---|---|---|---|---|
| 3,501,987 | A * | 3/1970 | Schneider | B26D 7/1818 | 83/125 |
| 4,160,396 | A * | 7/1979 | Matzner | B26D 7/1818 | 83/100 |
| 4,391,171 | A * | 7/1983 | Wendt | B26D 5/18 | 83/125 |
| 2010/0143015 | A1 * | 6/2010 | Kubota | G03G 15/6582 | 399/407 |

FOREIGN PATENT DOCUMENTS

| | | | |
|---|---|---|---|
| JP | 2011-084047 | A | 4/2011 |
| JP | 2011084047 | A * | 4/2011 |
| JP | 2013-0099850 | A | 5/2013 |

* cited by examiner

*Primary Examiner* — Jennifer Simmons
(74) *Attorney, Agent, or Firm* — Manabu Kanesaka

(57) ABSTRACT

This sheet punching device includes a placement table 53 on which the sheet is placed, a hollow punching member 60 that punches the sheet placed on the placement table 53, a punching moving member 66 that moves the punching member between a punching position where the sheet is punched and a retreat position retreated from the punching position, a punching drive section 70 that drives the punching moving member 66, a waste pushing member 80 that is disposed in the hollow portion of the punching member 60 and pushes punching waste remaining in the hollow portion, a pushing moving member 85 that moves the waste pushing member 80 between a pushing position protruding from the hollow portion of the punching member and a housing position in the hollow portion, and a pushing drive section 70 that drives the pushing moving member 85.

11 Claims, 11 Drawing Sheets

FIG. 10A In case where pushing operation is performed for each punching operation (punching operation is performed for eight sets)
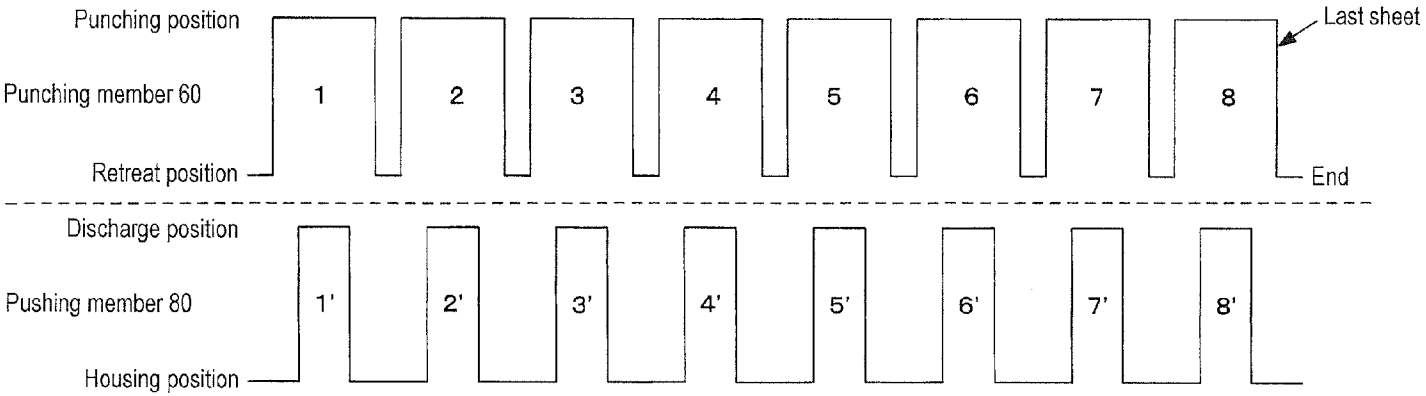
FIG. 10B In case where pushing operation is performed intermittently (punching operation is performed for eight sets)
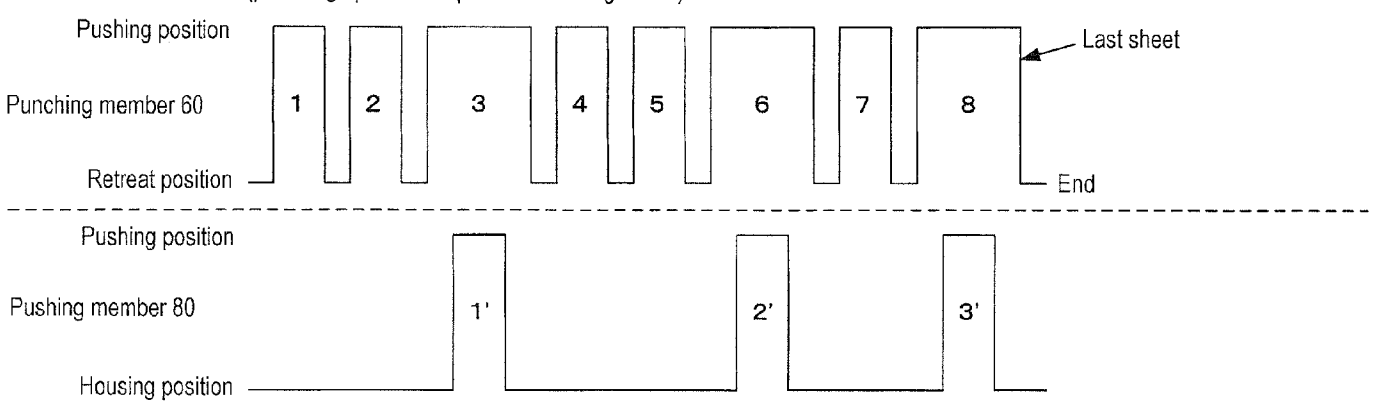

SHEET PUNCHING DEVICE, SHEET PROCESSING DEVICE PROVIDED WITH THE SAME, AND IMAGE FORMING DEVICE

BACKGROUND OF THE INVENTION

1. Field of the Invention

The present invention relates to a device that punches a sheet bundle obtained by bundling sheets sequentially delivered from an image forming device such as a copier or a printer and stacked and, more particularly, to a device capable of collectively punching a two-folded sheet bundle.

2. Description of the Related Art

There are widely known sheet processing device that align sheets delivered from an image forming device and staple the sheets or fold the sheets in a booklet form. Among these, some processing devices are configured to saddle-stitch the sheets using a staple or adhesive and then to fold them into a booklet form. In such devices, the sheets are subjected to punching one by one immediately after being discharged from the image forming device, followed by binding or center folding. However, in a case where the punching processing is performed before the binding or center folding, the punched positions may be displaced in a subsequent folded state.

To prevent the displacement in the punched position between the sheets, there is known a sheet processing device that performs binding or center folding first and then collectively performs the punching processing for the bound or folded sheets.

For example, Jpn. Pat. Appln. Laid-Open Publication No. 2011-84047 discloses a device that collectively punches punch holes in a saddle-stitched and folded sheet bundle.

In the above device, a saddle-stitching device, a three-side cutting device, and a punching device are connected to each other in this order in a sheet conveying direction. The punching device is configured to hold a sheet bundle by means of upper and lower block bodies and collectively punches punch holes in the sheet bundle using punching blades protruding from inside the upper and lower block bodies, respectively.

Further, Jpn. Pat. Appln. Laid-Open Publication No. 2013-99850 discloses a punching device that manually punches a center-folded sheet bundle, not automatically. This device uses a hollow cylindrical punching blade so as to punch a larger number of stacked sheets. Further, in this device, a waste discharging rod is fitted inside the hollow of the punching blade through a spring. The rod is configured to push punching waste that remains inside the hollow of the punching blade after the punching processing outside the punching blade. That is, the waste discharging rod is pressed against the stacked sheets while the punching blade punches the stacked sheets, whereby the punching waste is pushed outside the punching blade.

The device that performs the collective punching processing for the sheet bundle, especially, a folded sheet bundle or device that pushes punching waste in the punching blade has the following problems.

First, the device disclosed in Jpn. Pat. Appln. Laid-Open Publication No. 2011-84047 is configured to perform the collective punching processing for the folded sheet bundle. Thus, the punched positions of the sheets are not displaced to thereby provide a better finish than in a case where the conventional method in which the punching processing is performed one by one for the sheets delivered from an image forming device. However, larger force needs to be applied to the punching blade in order to collectively punch the sheet bundle in which a plurality of sheets are stacked. For example, a force of about 50 kg is required to punch a 20-page sheet bundle obtained by folding 10 sheets in the center, and the larger the number of sheets constituting the sheet bundle, the larger this force should be. This involves increase in size and stiffness of the device and increase in drive force.

To cope with this problem, as disclosed in Jpn. Pat. Appln. Laid-Open Publication No. 2013-99850, the punching blade is formed to have a hollow cylindrical structure. This can reduce resistive force of the sheets against the punching blade, whereby power for punching the sheets can be saved. In addition, the punching waste remaining in the hollow portion of the punching blade can be discharged by means of the discharging rod.

However, the discharge rod disclosed in Jpn. Pat. Appln. Laid-Open Publication No. 2013-99850 is fitted to the punching blade through a spring and operates integrally with the punching blade. Therefore, even though the punching blade is formed into the hollow shape to reduce penetration resistance against the sheets, the punching blade presses the sheets together with the discharging rod in the middle of the punching operation, the resistive force of the sheets is not reduced sufficiently. Further, when the sheets to be punched are thin papers or when the number of sheets to be punched is small, the discharging rod pushed by the spring pushes the sheets in the middle of the punching operation, so that a residue of punching waste is caused or a punching shape does not become constant. When force of the spring interposed between the punching blade and discharging rod is reduced so as to prevent the above situation, the punching waste remaining in the hollow portion of the punching blade cannot be discharged sufficiently.

SUMMARY OF THE INVENTION

The present invention has been made in view of the above problems and a first object thereof is to provide a device capable of performing an operation of punching the sheets and an operation of pushing the punching waste in an independent manner so as to reliably push the punching waste remaining inside a punching member and capable of maintaining quality of a punch hole shape.

Further, a second object of the present invention is to provide a device capable of controlling whether or not to perform the waste pushing operation in accordance with the number of sheets or a thickness thereof placed on a placement table so as to achieve an effective punching operation or an effective pushing operation of the punching waste generated in the punching operation.

The present invention adopts the following configuration to achieve the first object. That is, there is provided a sheet punching device that applies punching processing to a sheet, the device including: a placement table on which the sheet is placed; a hollow punching member that punches the sheet placed on the placement table; a punching moving member that moves the punching member between a punching position where the sheet is punched and a retreat position retreated from the punching position; a punching drive section that drives the punching moving member; a waste pushing member that is disposed in the hollow portion of the punching member and pushes punching waste remaining in the hollow portion; a pushing moving member that moves the waste pushing member between a pushing position protruding from the hollow portion of the punching member and a housing position in the hollow portion; and a pushing drive section that drives the pushing moving member.

Further, the invention adopts the following configuration to achieve the second object. That is, there is provided a sheet punching device that applies punching processing to a conveyed sheet, the device including: a placement table on which the sheet is placed; a hollow punching member that punches the sheet placed on the placement table; a punching moving member that moves the punching member between a punching position where the sheet is punched and a retreat position retreated from the punching position; a punching drive section that drives the punching moving member; a waste pushing member that is disposed in the hollow portion of the punching member and pushes punching waste remaining in the hollow portion; a pushing moving member that moves the waste pushing member between a pushing position protruding from the hollow portion of the punching member and a housing position in the hollow portion; a pushing drive section that drives the pushing moving member; and a punching controller that controls the punching drive section and the pushing drive section, wherein the punching controller controls, according to attribute information of a sheet placed on the placement table, whether a waste pushing operation of the waste pushing member is performed for each punching operation or intermittently.

The present invention provides the following effects by the configuration to achieve the first object.

Movement of the hollow punching member that punches the sheets between the punching position and retreat position retreated from the punching position and movement of the waste pushing member that is slid in the hollow portion of the punching member between the pushing position and housing portion in the hollow portion are controlled independently, so that the punching of the sheets can be performed with the hollow structure to reduce penetration resistance against the sheets, thereby allowing further saving of power required for the punching operation.

Further, the waste pushing member can be smoothly moved, thereby smoothly discharging the punching waste from inside the punching member by the punching waste pushing operation and preventing deterioration in quality of a punch hole.

The present invention provides the following effects by the configuration to achieve the second object.

Drive of the hollow punching member that punches the sheets between the punching position and the retreat position retreated from the punching position and drive of the waste pushing member that is slid in the hollow portion of the punching member between the pushing position and the housing portion in the hollow portion are controlled independently and based on the sheet attribute information, so that further saving of power required for the punching operation is achieved, and the waste pushing member can be smoothly moved. Further, the punching waste pushing operation can be intermittently performed according to need, thereby reducing a time required for the punching processing.

BRIEF DESCRIPTION OF THE DRAWINGS

FIGS. 5A to 5C are views each illustrating states of tip ends of a punching member and a waste pushing member which are provided in the sheet punching device, in which FIG. 5A is a view illustrating a state where the waste pushing member is housed in a hollow portion of the punching member, FIG. 5B is a view illustrating a state where the punching member is moved to a punching position for punching sheets, and FIG. 5C is a view illustrating a state where the waste pushing member is moved to a pushing position from the hollow portion of the punching member;

FIGS. 6A to 6C are operation state views each illustrating a punching operation and a pushing operation of the respective punching member and the waste pushing member of the sheet punching device illustrated in FIGS. 3 and 4, in which FIG. 6A illustrates a state where the punching member and the waste pushing member are situated at their initial positions, FIG. 6B illustrates a state where the punching member punches the folded sheet bundle, and FIG. 6C illustrates a state where the waste pushing member pushes the punching waste in the hollow portion of the punching member;

FIGS. 7A to 7C are operation state views continued from FIG. 6C, each illustrating returning operation of the punching member after completion of the punching operation and returning operation of the waste pushing member after completion of the pushing operation, in which FIG. 7A illustrates a state where the punching and waste pushing operations are completed, FIG. 7B illustrates a state where the waste pushing member is returned to the initial position thereof, and FIG. 7C illustrates a state where the punching member is returned to the initial position thereof and where all the members are returned to their initial positions;

FIGS. 10A and 10B each schematically illustrate operations of the punching and waste pushing members of the sheet punching device, in which FIG. 10A illustrates a case where the waste pushing member is moved from the hollow portion of the punching member to a pushing position every time the punching member performs punching operation, and FIG. 10B illustrates a case where the waste pushing member is intermittently moved from the hollow portion to the pushing position after punching operation of the punching member is performed a predetermined number of times (three times)

DESCRIPTION OF THE EMBODIMENTS

Figure 1:
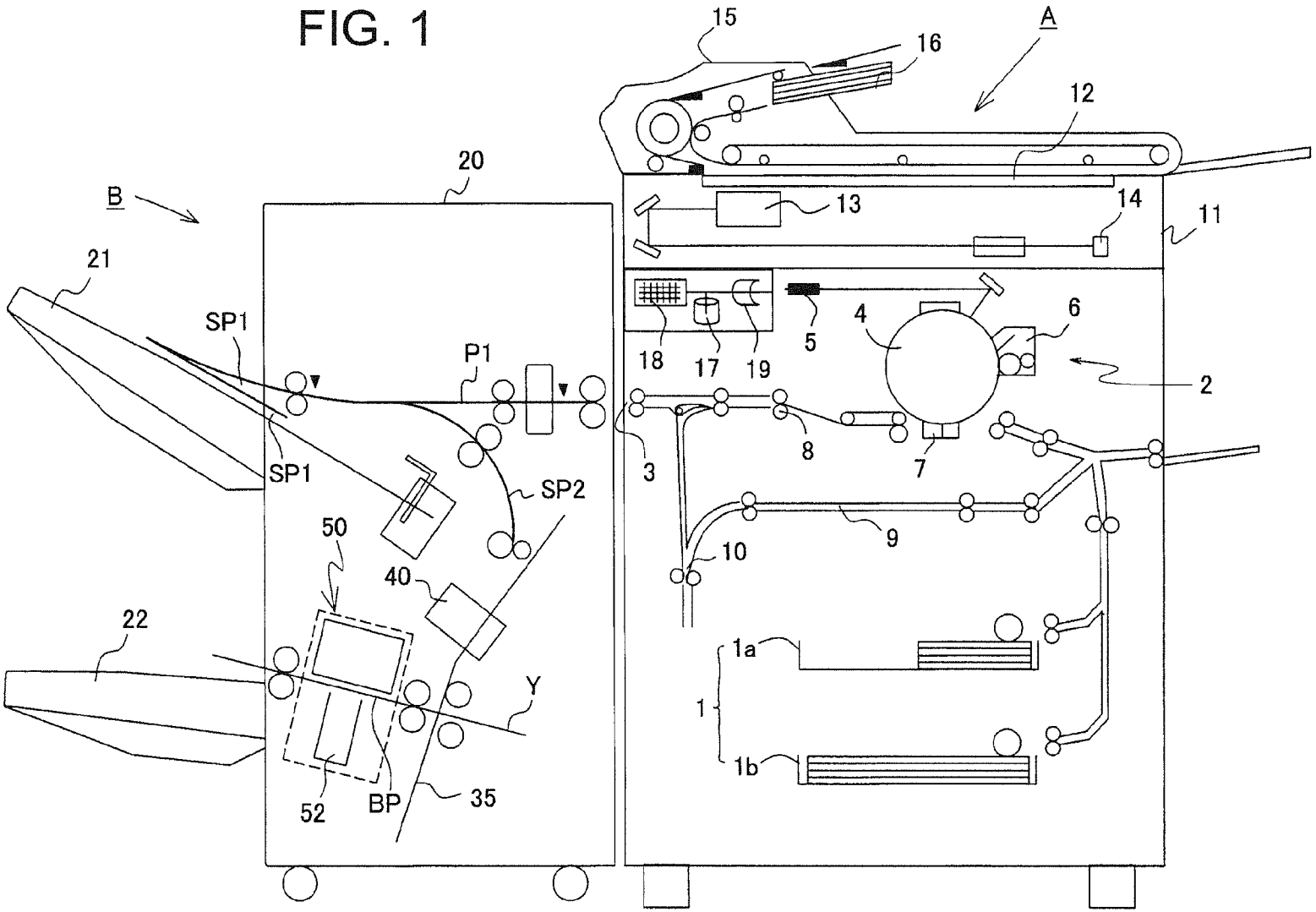
FIG. 1 is a view illustrating an entire configuration including an image forming device according to the present invention and a sheet processing device incorporating a sheet punching device.
Figure 2:
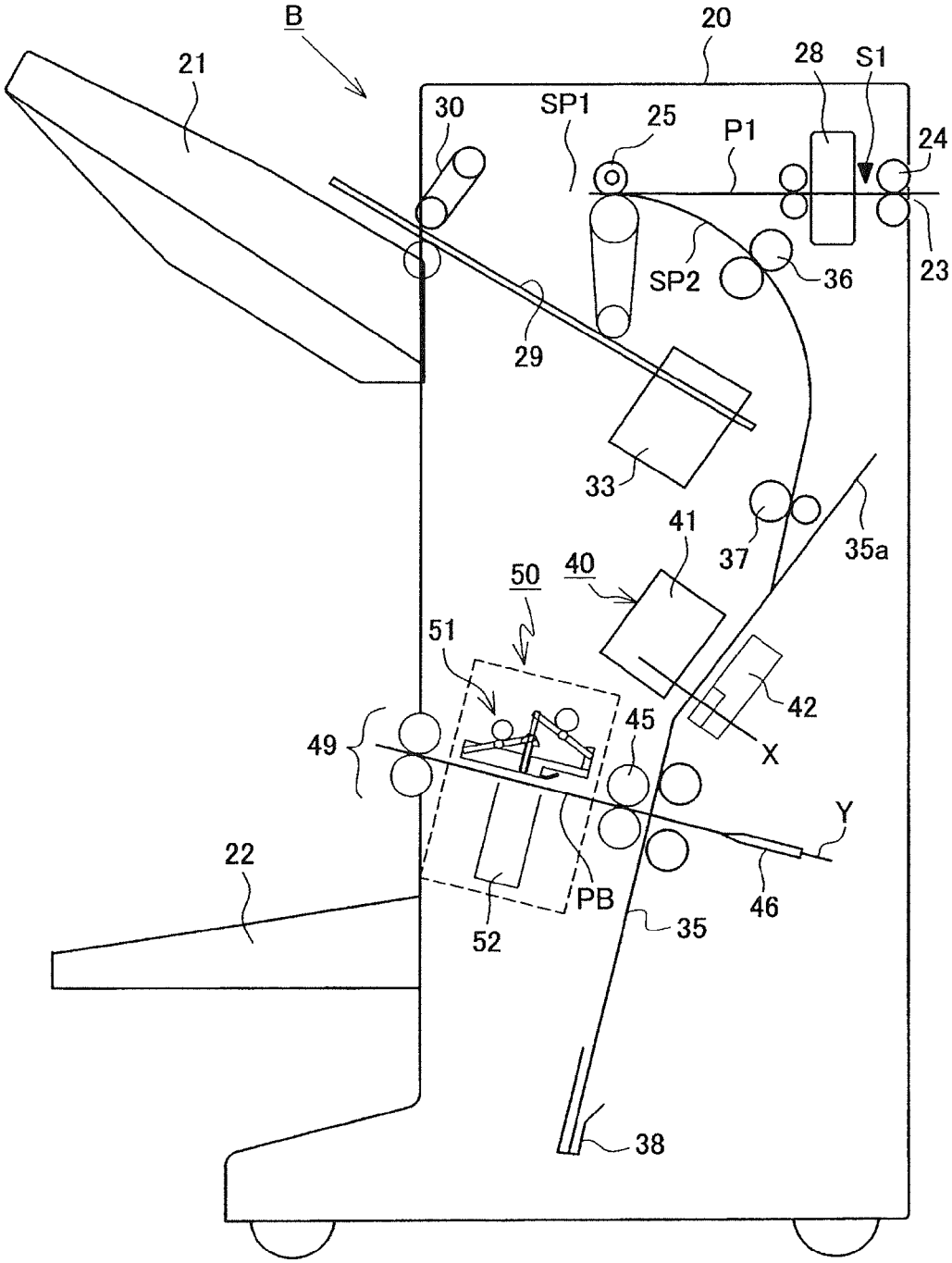
FIG. 2 is a view illustrating an entire configuration of the sheet processing device incorporating the sheet punching device according to the present invention.
Figure 3:
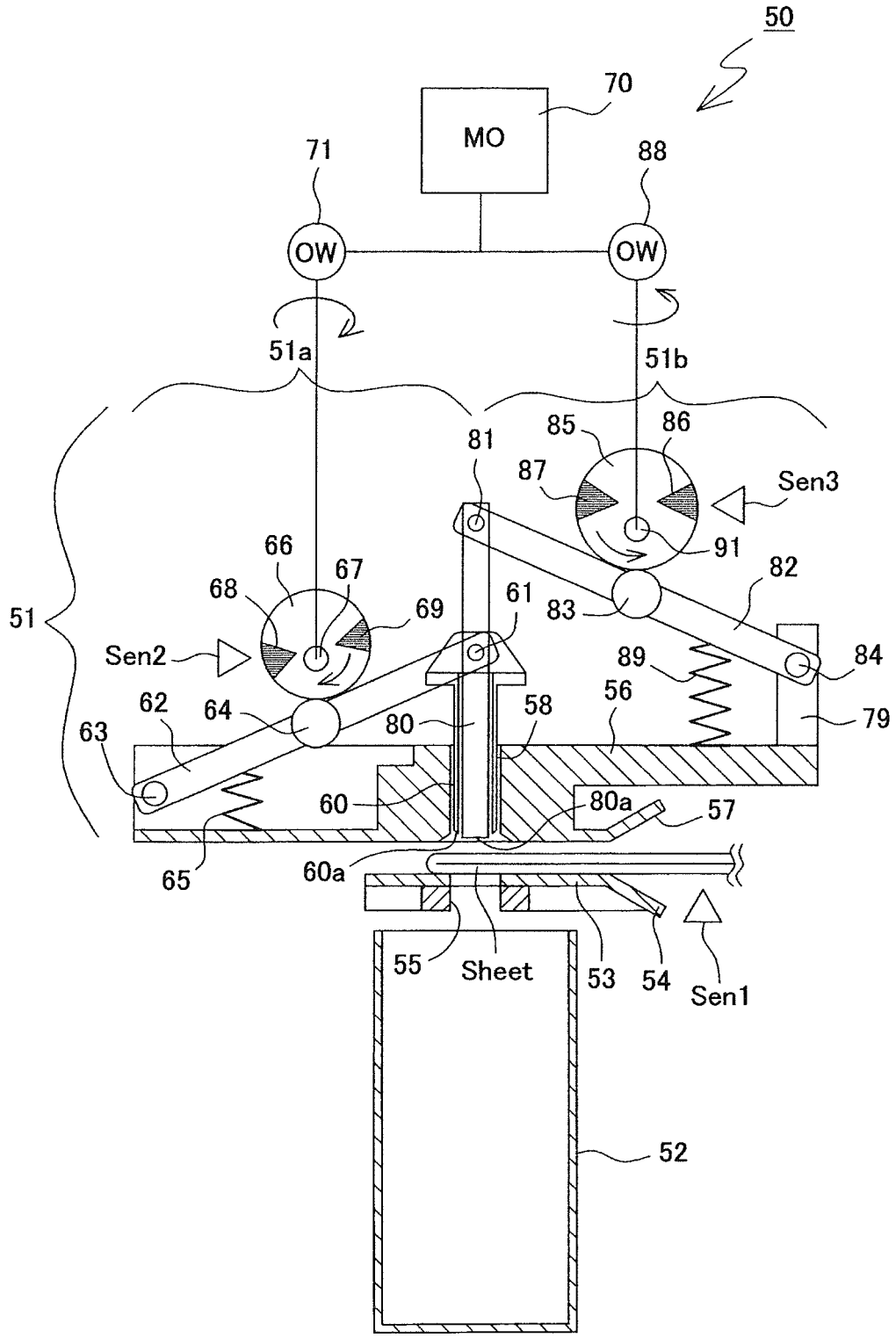
FIG. 3 is a cross-sectional side view illustrating the sheet punching device of FIG. 2.
Figure 4:
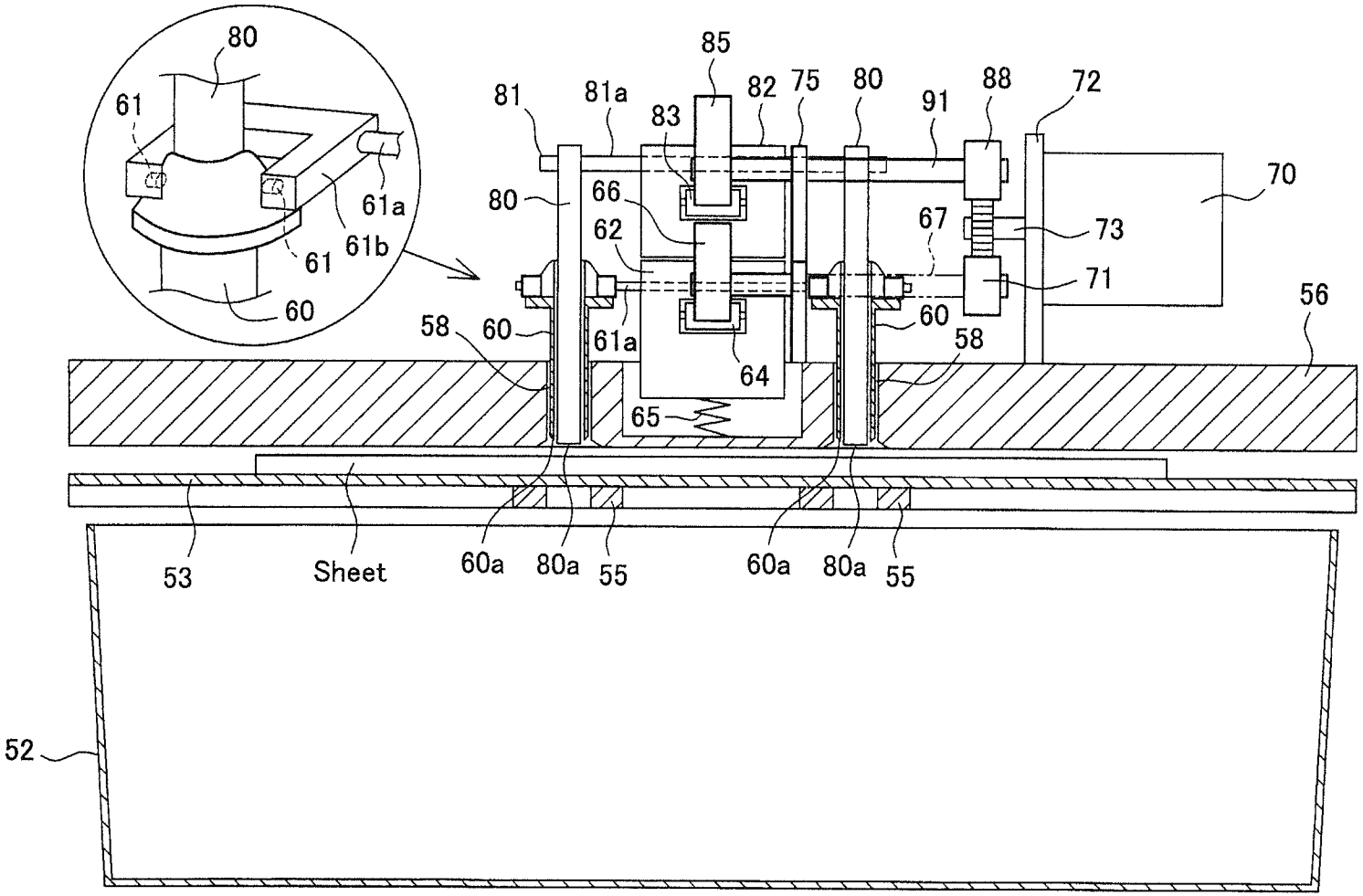
FIG. 4 is a cross-sectional front view illustrating the sheet punching device of FIG. 3 as viewed from a sheet discharge side.
Figure 5C:
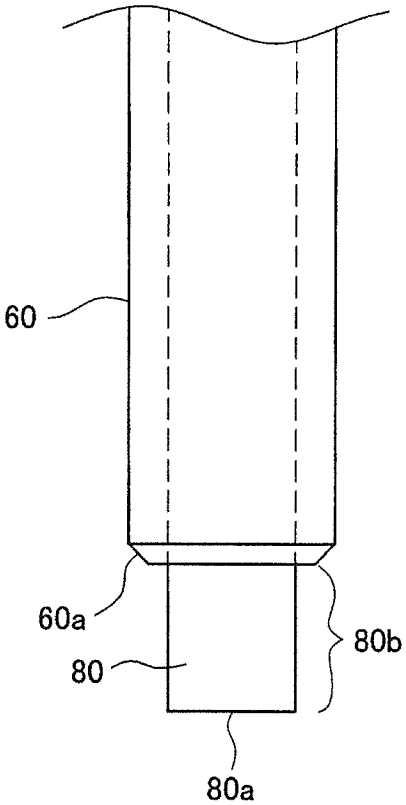
Figure 5B:
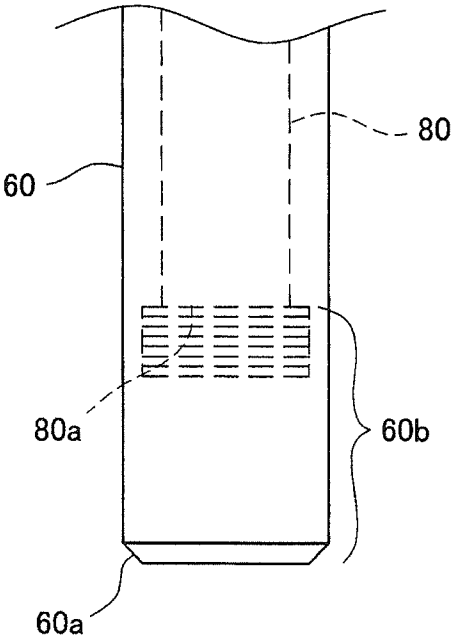
Figure 5A:
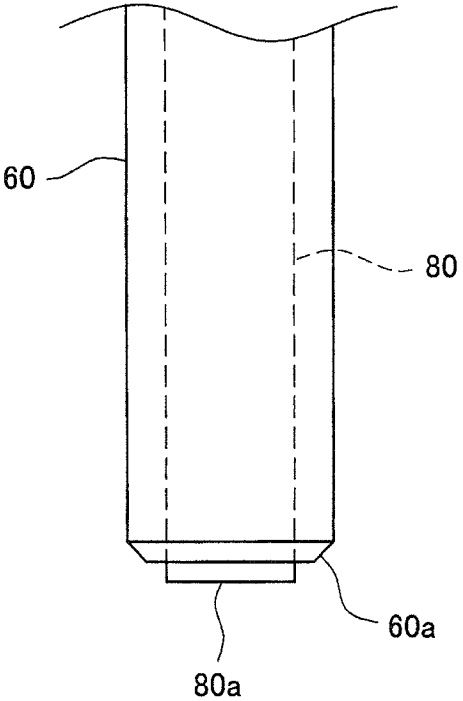

The present invention will be described in detail below based on an illustrated embodiment. FIG. 1 is a view illustrating an entire configuration including an image forming device according to the present invention, FIG. 2 is a view illustrating an entire configuration of a sheet processing device, FIG. 3 is a cross-sectional side view illustrating a sheet punching device provided inside the sheet processing device, FIG. 4 is a cross-sectional front view illustrating the sheet punching device, and FIGS. 5A to 5C are enlarged views each illustrating a punching member and a pushing member for pushing punching waste which are provided in the sheet punching device. A system illustrated in FIG. 1 is constituted by an image forming device A and a sheet processing device B. The sheet processing device B incorporates a sheet punching device 50 as a unit.

[Configuration of Image Forming Device]

The image forming device A illustrated in FIG. 1 feeds a sheet from a sheet supply section 1, performs printing in an image forming section 2, and discharges the sheet after printing from a main body discharge port 3. Sheets of a plurality of sizes are accommodated in sheet cassettes 1*a* and 1*b*, and the sheet supply section 1 separates, one from the other, sheets of a specified size or the like and feeds them one by one to the image forming section 2. The image forming section 2 includes an electrostatic drum 4, a print head (laser emitter) 5, a developing unit 6, a transfer charger 7, and a fixing unit 8. The print head 5, developing unit 6, transfer charger 7, and fixing unit 8 are disposed around the electrostatic drum 4. An electrostatic latent image is formed on the electrostatic drum 4 using the laser emitter 5, the developing unit 6 adds toner to the image, the transfer charger 7 transfers the image onto the sheet, and the fixing unit 8 thermally-fixes the image. The sheet with thus formed image is sequentially delivered from the main body discharge port 3. A reference numeral 9 in FIG. 1 denotes a circulation path, which is a path for two-side printing in which the sheet printed on the front side from the fixing unit 8 is reversed via a main body switchback path 10 and is fed to the image forming section 2 again for printing on the back side of the sheet. The sheet thus printed on both sides is reversed in the main body switchback path 10 and is delivered from the main body discharge port 3.

A reference numeral 11 in FIG. 1 denotes an image reader, where a document sheet set on a platen 12 is scanned by a scan unit 13 and is electrically read by a photoelectric conversion element 14 through a reflective mirror and a condensing lens. This image data is subjected to, e.g., digital processing by an image processor and is subsequently transferred to a data storage section 17, and an image signal is sent to the laser emitter 5. A reference numeral 15 denotes a document feeder that feeds document sheets stored in a stacker 16 to the platen 12.

The image forming device A having the above-described configuration is provided with a control section (controller). Image forming conditions are set via a controller panel 18, for example, printout conditions such as a sheet size specification, a color or black-and-white printing specification, a print copy count specification, single- or double-side printing specification, and enlarged or reduced printing specification. On the other hand, in the image forming device A, image data read by the scan unit 13 or transferred through an external network is stored in the data storage section 17. The image data stored in the data storage section 17 is transferred to a buffer memory 19, which sequentially transfers data signals to the laser emitter 5.

Simultaneously with the image forming conditions, sheet processing conditions are input and specified via the controller panel 18. Details of the sheet processing conditions will be described later.

[Configuration of Sheet Processing Device]

The sheet processing device B connected to the above-described image forming device A receives a sheet with the image formed thereon from the main body discharge port 3 of the image forming device A and is configured to selectively perform the following sheet processing: (1) storing the sheet with the image formed thereon in a first sheet discharge tray 21 ("printout mode"); (2) aligning the sheets from the main body discharge port 3 in a bundle, binding them using an end surface stapler 33 and then storing the bound sheets in the first sheet discharge tray ("staple-binding mode"); (3) aligning the sheets from the main body discharge port 3 in a bundle in a stacker section 35 which is a second processing tray, binding them at a portion near a center thereof using a saddle stitching stapler 40, folding the bound sheet bundle in a booklet form, and storing the resultant sheet bundle in a second sheet discharge tray 22 ("sheet bundle saddle stitching and folding mode"); and (4) collectively punching a saddle-stitched and folded sheet bundle at a portion near a fold line and storing the resultant sheet bundle in the second sheet discharge tray 22 ("center-folded sheet bundle collective punching mode").

In the above "center-folded sheet bundle collective punching mode", it is possible to select whether to execute a waste pushing operation for each sheet bundle or intermittently in accordance with sheet attribute information such as the number of sheets or a thickness thereof. Further, a setting of "manual waste pushing" in which the waste is forcibly pushed in a final processing stage according to an instruction from an operator is also available. Details of the above settings relating to the waste removal will be described later.

As illustrated in FIG. 2, the sheet processing device B is provided with the first sheet discharge tray 21 and the second sheet discharge tray 22 in a casing 20. Further, the device B is provided with a sheet carry-in path P1 having a carry-in port 23 continued to the main body discharge port 3. The sheet carry-in path P1 is formed of a straight-line path in a substantially horizontal direction in the casing 20. Further, there are provided a first switchback conveying path SP1 and a second switchback conveying path SP2 that branch off from the sheet carry-in path P1 to transport a sheet in an inverse direction. The first switchback conveying path SP1 branches off from the sheet carry-in path P1 to the downstream side of the sheet carry-in path P1, the second switchback conveying path SP2 branches off from the sheet carry-in path P1 to the upstream side of the sheet carry-in path P1, and the paths SP1 and SP2 are disposed spaced apart from each other.

In such a path configuration, in the sheet carry-in path P1, there are disposed a carry-in roller 24 and a sheet discharge roller 25. The sheet discharge roller 25 is configured to be rotatable in normal and reverse directions. Further, in the sheet carry-in path P1, there is disposed a path switching piece (not illustrated) for guiding a sheet to the second switchback conveying path SP2, and the piece is coupled to an operation means such as a solenoid. Further, the sheet carry-in path P1 has, on the downstream side of the carry-in roller 24, a stamp means for performing stamping on a sheet from the carry-in port or a single-sheet punching unit 28 for punching the sheets from the carry-in port 23 one by one.

[Configuration of First Switchback Conveying Path SP1]

The first switchback conveying path SP1 disposed on the downstream side (rear end portion of the device) of the sheet carry-in path P1 as illustrated in FIG. 2 is configured as described below. The sheet carry-in path P1 is provided, at its exit end, with the sheet discharge roller 25 and a processing tray 29 on which sheets fed by the sheet discharge roller 25 are stacked and supported. There is disposed, above the processing tray 29, a normal/reverse rotation roller 30 capable of moving up and down between a position to come into contact with the sheet on the tray and a standby position spaced apart from the contact position. The normal/reverse rotation roller 30 is controlled to rotate in a clockwise direction in FIG. 2 when a sheet approaches the processing tray 29 to which the normal/reverse rotation roller 30 is coupled, and to rotate in a counterclockwise direction after a sheet rear end enters the processing tray 29. Thus, the first switchback conveying path SP1 is configured above the processing tray 29.

Further, the first sheet discharge tray 21 is located downstream of the first switchback conveying path SP1 and is configured to support a leading end of sheet guided to the first switchback conveying path SP1 and second switchback conveying path SP2.

An end surface stapler 33 is disposed at a rear end portion of the processing tray 29 in the sheet discharge direction. The illustrated end surface stapler 33 staples a sheet bundle stacked on the processing tray 29 at one or more positions of a rear end edge of the sheet bundle. The staple-bound sheet bundle is discharged onto the first sheet discharge tray 21.

The first switchback conveying path SP1 configured as described above aligns the sheets fed by the sheet discharge roller 25 on the processing tray 29 in the "(2) staple-binding mode" as described above, and the end surface stapler 33 staples the sheet bundle at one or more portions of the rear end edge of this sheet bundle. In the "(1) printout mode", a sheet fed by the sheet discharge roller 25 is not subjected to the switchback, but the sheet conveyed along the processing tray 29 is delivered to the first sheet discharge tray 21 by a rotation of the normal/reverse rotation roller 30 in a clockwise direction in FIG. 2.

[Configuration of Second Switchback Conveying Path SP2]

The following describes a configuration of the second switchback conveying path SP2 branching off from the sheet carry-in path P1. The second switchback conveying path SP2 is a conveying path for guiding switchback-conveyed sheet. That is, in a state where the sheet is nipped by the sheet discharge roller 25, rotation of the sheet discharge roller 25 is changed from the normal rotation to reverse rotation, with the result that the sheet is switchback-conveyed along the switchback conveying path SP2. As illustrated in FIG. 2, the second switchback conveying path SP2 is located in a substantially vertical direction inside the casing 20. A conveying roller 36 is located at an inlet of the second switchback conveying path SP2, and a conveying roller 37 is located at an outlet of the second switchback conveying path SP2. A stacker section 35 constituting a second processing tray that aligns and temporarily stacks the sheets fed along the second switchback conveying path SP2 is provided downstream of the second switchback conveying path SP2. The illustrated stacker section 35 includes a conveying guide that transfers the sheets. A saddle stitching stapler 40 and folding roller 45 are arranged along the stacker section 35. The configuration of these components will be sequentially described below.

[Configuration of Stacker Section]

The stacker section 35 is formed of a guide member that guides the sheet being conveyed. The stacker section is configured such that the sheets are stacked and housed thereon. The illustrated stacker section 35 is connected to the second switchback conveying path SP2 and located in a center portion of the casing 20 so as to extend in the substantially vertical direction. This allows the device to be compactly configured. The stacker section 35 is shaped to have an appropriate size to house maximum sized sheets. In particular, the illustrated stacker section 35 is curved or bent so as to project toward an area in which the saddle stitching stapler 40 or the folding roller 45 to be described later is arranged.

A switchback approaching path 35*a* is connected to a conveying direction rear end of the stacker section 35. The switchback approaching path 35*a* overlaps the outlet end of the second switchback conveying path SP2. This is to allow the leading end of a carried-in (succeeding) sheet fed from the conveying roller 37 on the second switchback conveying path SP2 to overlap the rear end of the stacked (preceding) sheets supported on the stacker section 35 to ensure the page order of the stacked sheets. A leading end regulating member (hereinafter, referred to as stopper 38) regulating a sheet leading end of the sheet in the conveying direction is located downstream of the stacker section 35. The stopper 38 is supported by a guide rail and the like so as to be movable along the stacker section 35. The stopper 38 is configured to be movable to a position where the sheet is carried in the stacker section 35, a position where the sheet (bundle) is bound at a center thereof in the stacking direction, and to a position where the sheet (bundle) is folded by the folding roller 45.

[Saddle Stitching Stapler]

The saddle stitching stapler 40 positioned above the stacker section 35 includes a driver unit 41 and a clincher unit 42 which are arranged opposite to each other with respect to the stacker section 35. The driver unit 41 drives a staple into a sheet bundle. The clincher unit 42 bends leg portions of the driven staple in a direction facing each other. With this configuration, the sheet bundle is bound at a binding position X illustrated in FIG. 2 corresponding to the half of a sheet length. The saddle stitching stapler 40 may perform the binding not only by using a metallic staple, but also by using a paper-made staple, by performing press-bonding, or by forming a cut in the sheets.

[Folding Roller]

The following describes a configuration of the folding roller 45. As illustrated in FIG. 2, the folding roller 45 for folding the sheet bundle and a folding blade 46 for inserting the sheet bundle into a nip position of the folding roller 45 are disposed at a folding position Y set on the downstream side of the above-described saddle stitching stapler 40. The folding roller 45 includes a pair of pressure contact rollers which are brought into pressure contact with each other, and the pressure contact rollers each have a length corresponding to substantially the maximum width of the sheet. The pressure contact rollers are biased in the press contact direction by a not illustrated compression spring. The press contact rollers are each formed of a material, such as rubber, having a comparatively large friction coefficient.

Further, as illustrated in FIG. 2, the folding blade configured to be inserted toward the press contact position of the press contact rollers is disposed so as to be capable of advancing and retreating. After the sheet bundle is saddle stitched by the saddle stitching stapler 40, the folding blade 46 is moved to push the binding position between the folding roller pair to cause the folding roller pair to be rotated while pressed against each other, whereby the saddle stitched sheet bundle is center-folded. In the middle of the above folding processing, the folding blade 46 is returned to its original position and waits for the next sheet bundle. A movement path along which the folding blade moves is illustrated as the folding position Y which coincides with the binding position X of the sheet bundle.

[Sheet Punching Device]

The above folding roller 45 is configured not only to form a center-folded sheet bundle but also to convey downstream side the center-folded sheet bundle along a center-folded sheet bundle conveying path PB. At a downstream side of the center-folded sheet bundle conveying path PB, a bundle discharge roller 49 that discharges the center-folded sheet bundle to the second sheet discharge tray 22 is disposed. The sheet punching device 50 according to the present invention is disposed between the folding roller 45 and the bundle discharge roller 50 along the center-folded sheet bundle conveying path PB.

As illustrated in FIG. 2, in the sheet punching device 50, a base unit 51 and a punching waste box 52 are disposed above and below with respect to the center-folded sheet bundle conveying path PB. The punching waste box 52 disposed below the base unit 51 is configured to collect punching waste generated during the punching processing.

The following describes a configuration of the sheet punching device 50 according to the present invention with reference to FIGS. 3 to 5A to 5C. FIG. 3 is a cross-sectional side view of the sheet punching device 50 of FIG. 2, and FIG. 4 is a cross-sectional front view of the sheet punching device 50 as viewed from a bundle discharge side thereof. FIGS. 5A to 5C are views each illustrating states of tip ends of a punching member 60 and a waste pushing member 80 which are provided in the sheet punching device of FIGS. 3 and 4. FIG. 5A is a view illustrating a state where the waste pushing member 80 is housed in a hollow portion of the punching member 60, FIG. 5B is a view illustrating a state where the punching member 60 is moved to a punching position for punching sheets, and FIG. 5C is a view illustrating a state where the waste pushing member 80 is moved to a pushing position from the hollow portion of the punching member 60.

As illustrated in FIGS. 3 and 4, the sheet punching device 50 has a sheet placement table 53 disposed below the center-folded sheet bundle conveying path PB. The sheet placement table 53 is provided with a sensor Sen1 that detects a sheet conveyed from the folding roller 45 disposed upstream thereof and a punching die 55 through which a punching member tip end 60*a* serving as a punching blade of a punching member 60 to be described later.

On the other hand, above the center-folded sheet bundle conveying path PB, a unit base 56 provided with a sheet receiving upper guide 57 is disposed. The unit base 56 has a base through hole 58 formed therein through which the punching member 60 and the waste pushing member 80 serving as a rod-shaped pushing member that pushes punching waste generated during the punching processing from inside the punching member 60 penetrate.

A punching unit 51*a* and a waste pushing unit 51*b* are disposed respectively on the downstream and upstream sides (left and right sides) in the sheet conveying direction with respect to the base through hole 58. The punching unit 51*a* is configured to collectively punch the sheet bundle. The waste pushing unit 51*b* is configured to push punching waste remaining inside the punching member. Hereinafter, details of the punching unit 51*a* and the waste pushing unit 51*b* will be described.

[Punching Unit]

The punching unit 51*a* supports the punching member 60 so as to be vertically movable in the base through hole 58. The punching member 60 has a punching blade at a hollow cylindrical punching member tip end 60*a*. An upper end of the punching member 60 is formed into an umbrella shape. The punching member 60 is provided with a punching lever 62. One end of the punching lever 62 has a punching lever bracket coupling portion 63 turnably coupled to the unit base 56, and the other end thereof has a punching lever coupling pin 61 coupled to the upper end umbrella portion of the punching member 60. A punching cam 66 is disposed in the middle of the punching lever 62 in a longitudinal direction thereof. The punching cam 66 is configured as a punching moving member constituted by an eccentric cam that swings the punching lever 62 about the punching lever bracket coupling portion 63. Further, a punching cam receiver 64 is disposed at a position corresponding to the punching cam 66 of the punching lever 62. Further, in the vicinity of the punching lever bracket coupling portion 63, a punching lever spring 65 is interposed between the punching lever 62 and the unit base 56. The punching lever spring 65 biases the punching lever 62 such that the punching cam receiver 64 always abuts against the punching cam 66 to press the punching cam 66 in its returning direction.

As illustrated in the partially enlarged view of FIG. 4, the umbrella portion of the punching member 60 and the punching lever coupling pin 61 are coupled to each other in such a manner that a moving pin 61*a* vertically moved with swing of the punching lever 62 is supported by a coupling member 61*b* from both sides of the umbrella portion.

The above punching cam 66 is coupled to a punching cam drive shaft 67 at an eccentric position and is connected, through a punching cam one-way clutch 71, to a single drive motor 70 as a punching drive section. Flags 68 and 69 for allowing a position of the punching cam 66 to be detected by a sensor (Sen2) are attached to a peripheral surface of the punching cam 66. A position where the flag 68 is detected by the sensor Sen2 corresponds to a punching cam home position where the punching member 60 is situated at a retreat position, and a position where the flag 69 is detected by the sensor Sen2 corresponds to a punching cam lower end position (lower end position of punching processing) where the punching processing of the punching member 60 is completed. Accordingly, detecting the same flag (68 or 69) twice corresponds to one vertical reciprocating movement of the punching member 60.

[Waste Pushing Unit]

The waste pushing unit 51*b* has a rod-shaped waste pushing member 80 fitted inside the hollow portion of the punching member 60 having a hollow cylindrical punching blade so as to be vertically slidable. The waste pushing member 80 is provided with a pushing lever 82. One end of the pushing lever 82 is turnably fitted to a moving bar support bracket 79 provided on the unit base 56 through a pushing bracket coupling portion 84, and the other end thereof is coupled to an upper end of the waste pushing member 80 through a pushing lever coupling pin 81. A pushing cam 85 is disposed in the middle of the pushing lever 82 in a longitudinal direction thereof. The pushing cam 85 is configured as a pushing moving member constituted by an eccentric cam that swings the pushing lever 82 about the pushing bracket coupling portion 84. Further, a pushing cam receiver 83 is disposed at a position corresponding to the pushing cam 85 of the pushing lever 82. Further, in the vicinity of the pushing bracket coupling portion 84, a pushing lever spring 89 is interposed between the pushing lever 82 and the unit base 56. The pushing lever spring 89 biases the pushing lever 82 such that the pushing cam receiver 83 always abuts against the pushing cam 85 and returns.

The above pushing cam 85 is coupled to a pushing cam drive shaft 91 at an eccentric position and is connected, through a pushing cam one-way clutch 88, to the drive motor as a pushing drive section. Flags 86 and 87 for allowing a position of the pushing cam 85 to be detected by a sensor (Sen3) are attached to a peripheral surface of the pushing cam 85. A position where the flag 86 is detected by the sensor Sen3 corresponds to a pushing cam home position where a waste pushing member tip end 80*a* of the waste pushing member 80 is situated at a housing position of the hollow portion of the punching member 60, and a position where the flag 87 is detected by the sensor Sen3 corresponds to a pushing position where the waste pushing member tip end 80*a* protrudes from the punching member 60 to penetrate through the punching die of the placement table 53. Accordingly, detecting the same flag (68 or 69) twice corresponds to one vertical reciprocating movement of the waste pushing member 80 in the hollow portion of the punching member 60.

[Punching Drive Section And Pushing Drive Section]

The following describes the above-mentioned drive motor 70 constituting the punching drive section and pushing drive section and a drive system thereof. As illustrated in FIG. 4, the drive motor 70 is fixed to a motor support bracket 72 erected on the unit base 56, and a motor drive shaft 73 of the drive motor 70 projects from the motor support bracket 72. Drive from the motor drive shaft 73 is branched by a gear mounted to the motor drive shaft 73 and connected to the punching cam drive shaft 67 through the punching cam one-way clutch 71 and to the pushing cam drive shaft 91 through the pushing cam one-way clutch 88.

Thus, when the motor drive shaft 73 of the drive motor 70 is rotated normally, the punching cam one-way clutch 71 is connected to the drive from the motor drive shaft 73 to drive the punching cam drive shaft 67 for moving the punching cam 66. A rotation of the punching cam 66 is detected by the sensor Sen2 for operation control.

On the other hand, when the motor drive shaft 73 of the drive motor 70 is rotated reversely, drive transmission through the punching cam one-way clutch 71 is disconnected, but the pushing cam one-way clutch 88 is connected to the drive from the motor drive shaft 73 to drive the pushing cam drive shaft 91 for pushing cam 85. A rotation of the pushing cam 85 is detected by a sensor Sen3 for operation control. The above sensors Sen2 and Sen3, drive motor 70, and sensor Sen1 that detects carry-in and carry-out of the sheet with respect to the sheet punching device are connected to a center-folded sheet collective punching controller 123 as a punching controller to be described later. The drive and drive direction of the drive motor 70 is controlled by the center-folded sheet collective punching controller 123. Thus, in the drive system of the present invention, the connection/disconnection of the drive is achieved by switching between normal rotation and reverse rotation of the drive motor 70, that is, a single drive source is used to realize the punching and pushing operations.

[Positional Relationship between Punching Member and Waste Pushing Member]

With reference to FIGS. 5A to 5C, the hollow cylindrical punching member 60 configured to be vertically movable in the base through hole of the unit base 56 and having the punching blade at its tip end and the rod-shaped waste pushing member 80 configured to be vertically movable in the hollow portion of the punching member 60 will be described. In the state of FIG. 5A, the punching member 60 is situated at the retreat position in the base through hole 58 of the unit base 56, and the waste pushing member 80 is situated at a housing position in the hollow portion of the punching member 60. In this state, neither the punching member tip end 60*a* of the punching member 60 nor the waste pushing member tip end 80*a* of the waste pushing member 80 protrudes downward from a lower surface of the unit base 56 so as not to impede conveyance of the folded sheet bundle fed along the center-folded sheet bundle conveying path PB.

In the state of FIG. 5B, the folded sheet bundle is punched at a predetermined position by the punching blade of the punching member 60. In this state, the hollow cylindrical punching member tip end 60*a* which is the punching blade of the punching member 60 is inserted into the punching die 55 illustrated in FIG. 3 to punch the folded sheet bundle. At this time, punching waste remains in the hollow portion of the punching member 60. A range within which the punching waste can remain is represented as a waste residual range 60*b*. In the present invention, punching waste of about 30 sheets can be housed in the waste residual range 60*b*. Thus, for example, punching waste of three sets of a folded sheet bundle composed of about 10 sheets in a folded state can be housed in the waste residual range 60*b*. In a case of a folded sheet bundle composed of a small number of sheets, the pushing operation may be performed once for several punching operations, thereby increasing processing efficiency. This point will be described later using FIGS. 10A and 10B.

In the state of FIG. 5C, the punching member tip end 60*a* of the punching member 60 is situated at a punching position where it is inserted into the punching die 55, and the rod-shaped waste pushing member 80 is situated at a pushing position where it pushes the punching waste remaining in the waste residual range 60*b* of the punching member 60 toward the punching waste box 52. In this state, the punching member tip end 60*a* is inserted into the punching die 55, so that the punching waste is reliably housed in the punching waste box 52 without falling to the center-folded sheet bundle conveying path PB and scattering thereon.

[Operation of Sheet Punching Device]

Figure 6A:
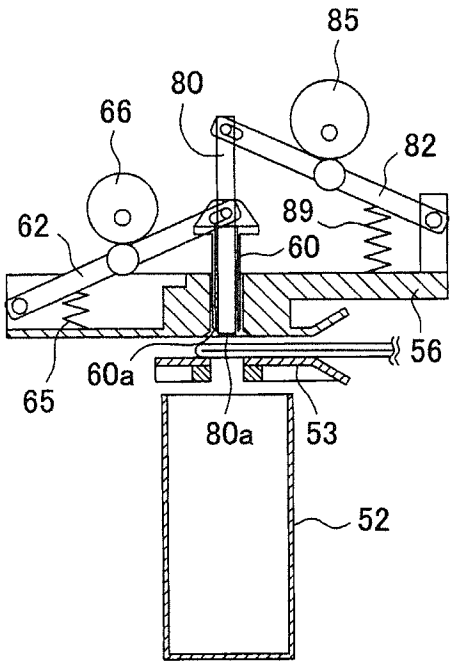
Figure 6B:
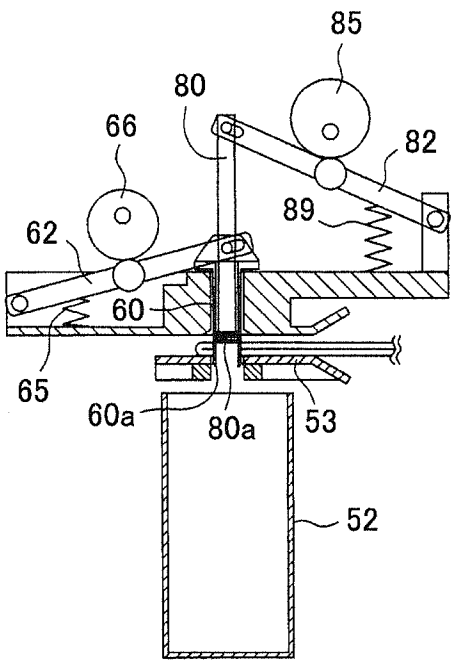
Figure 6C:
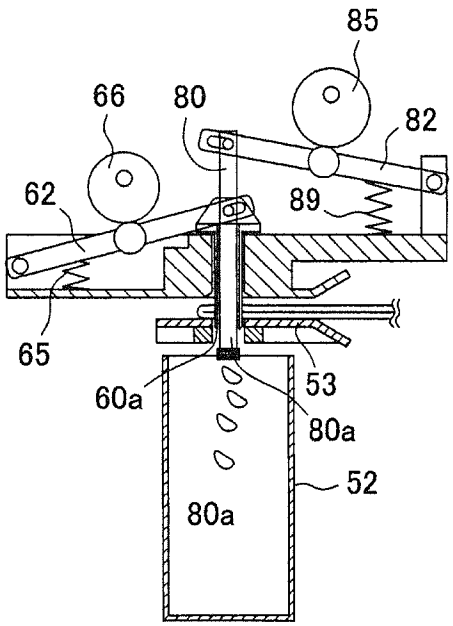

The following describes the punching operation and waste pushing operation of the sheet punching device 50 with reference to FIGS. 6A to 6C to FIG. 9. FIGS. 6A to 6C are operation state views each illustrating the punching operation and pushing operation of the respective punching member 60 and the waste pushing member 80 of the sheet punching device 50 illustrated in FIGS. 3 and 4. FIG. 6A illustrates a state where the punching member 60 and the waste pushing member 80 are situated at their initial positions, FIG. 6B illustrates a state where the punching member 60 punches the folded sheet bundle, and FIG. 6C illustrates a state where the waste pushing member 80 pushes the punching waste in the hollow portion of the punching member 60. In any of FIGS. 6A to 6C, forward stroke operations of the punching member 60 and the waste pushing member 80 are illustrated.

Figure 7C:
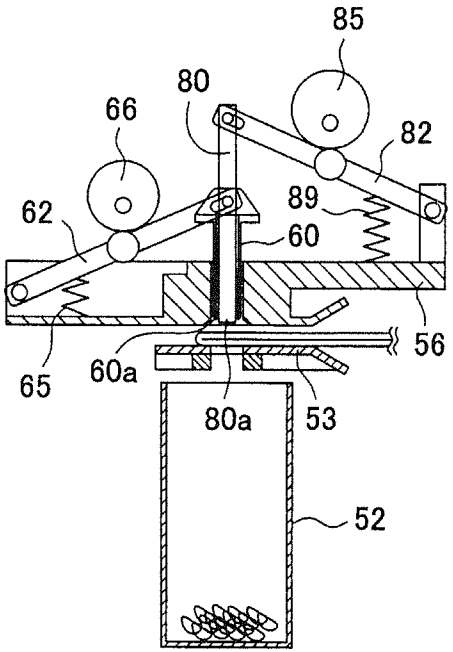
Figure 7B:
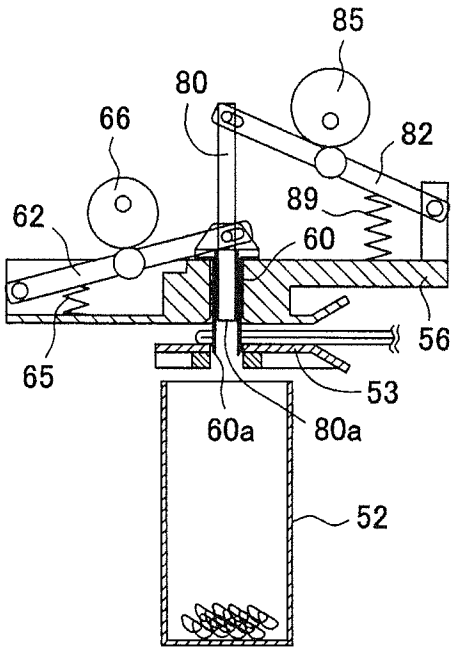
Figure 7A:
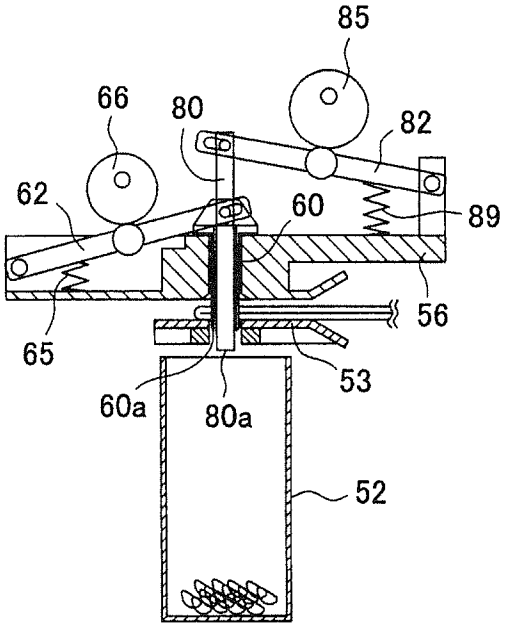

FIGS. 7A to 7C are operation state views continued from FIG. 6C, each illustrating returning operation of the punching member 60 after completion of the punching operation and returning operation of the waste pushing member 80 after completion of the pushing operation. FIG. 7A illustrates a state where the punching and waste pushing operations are completed, FIG. 7B illustrates a state where the waste pushing member 80 is returned to the housing position which is the initial position thereof, and FIG. 7C illustrates a state where the punching member 60 is returned to the retreat position which is the initial position thereof and where all the members are returned to their initial positions. In any of FIGS. 7A to 7C, backward stroke operations of the punching member 60 and the waste pushing member 80 are illustrated.

Figure 8:
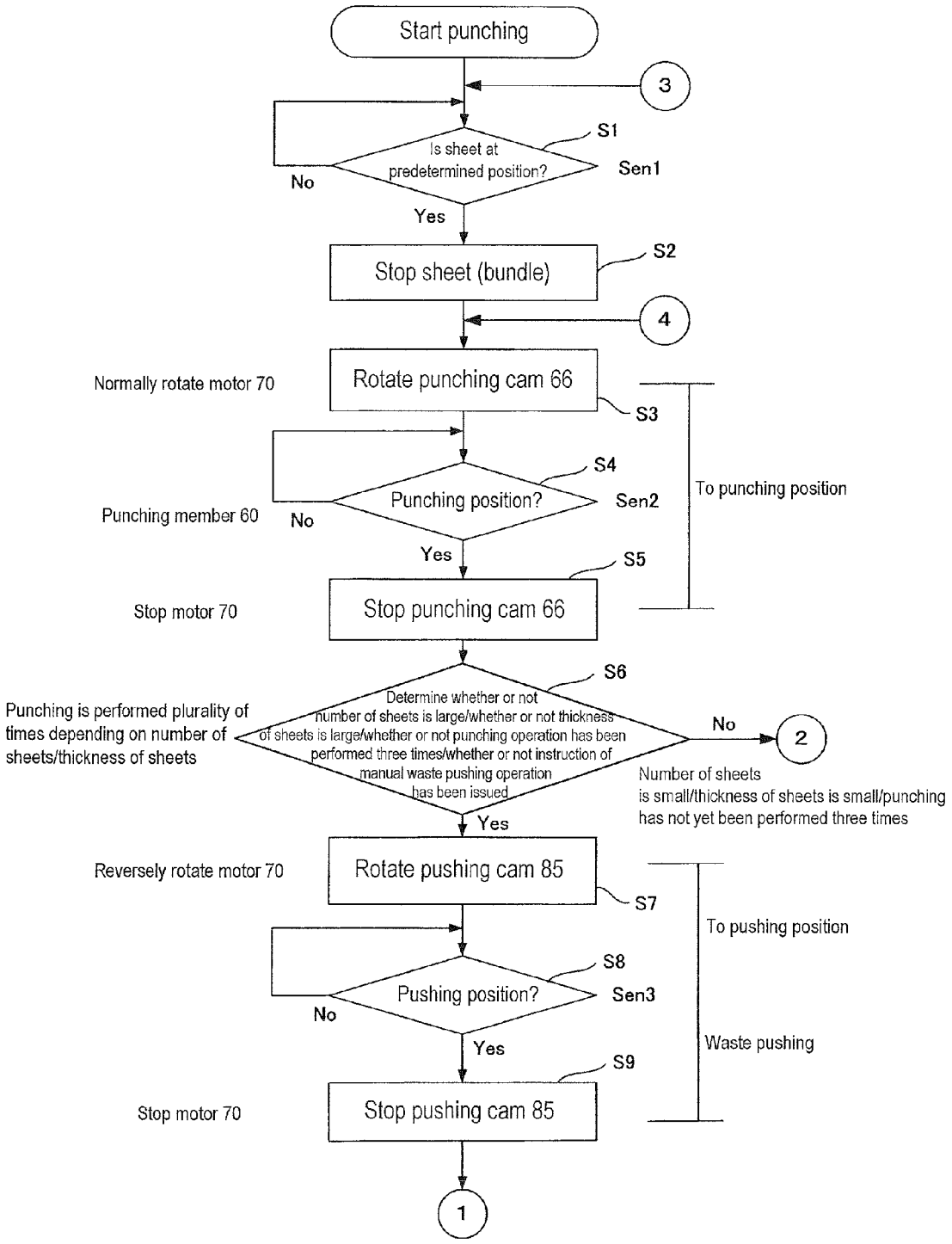
FIG. 8 is a flowchart illustrating the punching and waste pushing operations of the sheet punching device illustrated in FIGS. 6A to 6C and FIGS. 7A to 7C.
Figure 9:
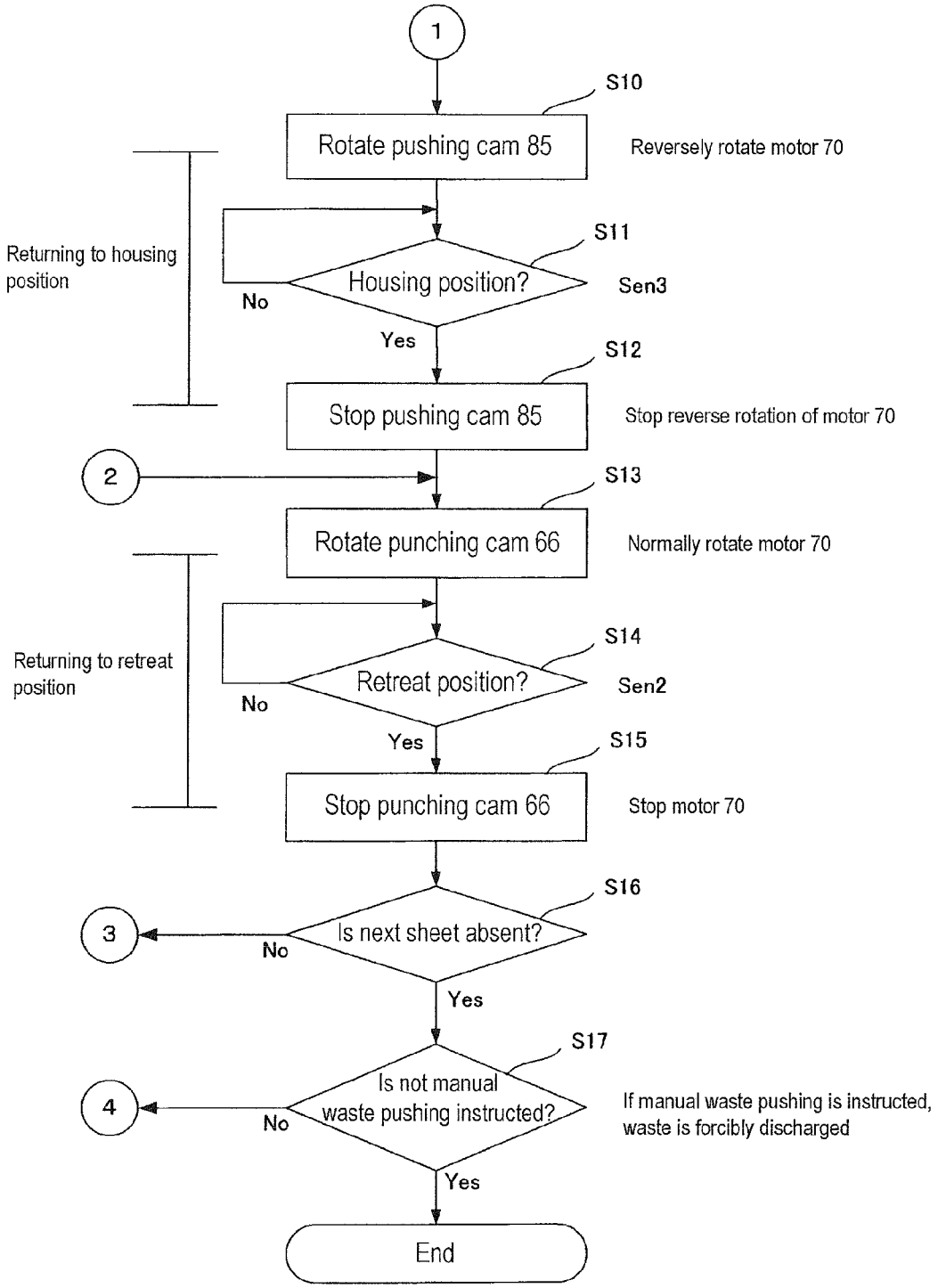
FIG. 9 is a flowchart continued from FIG. 8, illustrating the punching and waste pushing operations of the sheet punching device illustrated in FIGS. 6A to 6C and FIGS. 7A to 7C.

FIGS. 8 and 9 are flowcharts each illustrating the punching and waste pushing operations of the sheet punching device 50. For descriptive convenience, the operation states illustrated in FIGS. 6A to 6C and FIGS. 7A to 7C will be described along steps (represented by a combination of "S" and numeral) of the flowcharts of FIGS. 8 and 9.

[Forward Stroke Operation of Punching Member and Waste Pushing Member]

An operator uses an input means 111 to set the "center-folded sheet bundle collective punching mode" where collective punching processing is performed for the folded sheet bundle in a mode setting means 112 of an image forming device controller 110 to be described later. At this time, or during setting of this mode, the "manual waste pushing" where the punching waste is forcibly pushed can be set.

First, when a folded-side leading end of a first set of folded sheet bundle conveyed by the folding roller 45 is detected by the sensor Sen1, it is confirmed whether or not the leading end is situated at the punching position (S1). Thereafter, the folded sheet bundle is conveyed to a predetermined position where the punching processing is performed (S2). This state is illustrated in FIG. 6A, and the punching member 60 is situated at the retreat position, and the waste pushing member 80 is situated at the housing position where the tip end 80*a* thereof is housed in the hollow portion of the punching member. In this state, neither the punching member 60 nor the waste pushing member 80 protrudes from the lower surface of the unit base 56 so as not to impede conveyance of the folded sheet bundle along the center-folded sheet bundle conveying path PB.

After completion of the conveyance of the folded sheet bundle to a predetermined position where the punching processing can be performed (S2), the drive motor 70 starts being rotated in the normal direction (clockwise direction). This causes the punching cam 66 to be rotated in the clockwise direction in FIG. 6A (S3) to press down the punching lever 62. Then, the punching member tip end 60*a* of the punching member 60 having the hollow cylindrical punching blade penetrates through the punching die 55 in the placement table 53 to reach the punching position which is the predetermined position of the folded sheet bundle. The punching cam 66 is rotated until the flag 69 indicating a punching cam lower end position thereof illustrated in FIG. 3 is detected (S4). When the punching cam 66 is half-rotated, the flag 69 indicating the punching cam lower end position is detected by the sensor Sen2, which indicates that the punching member tip end 60*a* reaches the punching position, and then the normal rotation of the drive motor 70 driving the punching cam 66 is stopped (S5).

In step S6, it is determined whether or not the number of sheets constituting the folded sheet bundle punched through the above punching operation is larger than a predetermined value, whether or not a thickness of the sheets is larger than a predetermined value, whether or not the punching operation has been performed three times without the punching waste pushing operation, whether or not an instruction of the manual waste pushing operation has been issued, and the like based on a signal from the image forming device controller 110 and by the center-folded sheet collective punching controller 123. The above determinations may be made before the punching operation. Further, whether or not a thickness of the punched folded sheet bundle is larger than a predetermined value and whether or not an instruction of the manual waste pushing operation has been issued may be determined only in a sheet processing device controller 115, not instructed by an external device.

The following description will be made assuming that the number of sheets is equal to or larger than a predetermined value (for example, 32 sheets in a folded state). The number of sheets, which is one of the sheet attribute information, is larger than the predetermined value, so that a setting is made such that the center-folded sheet collective punching controller 123 performs the pushing operation for each punching operation with the waste pushing member 80. The folded sheet bundle is under a state being punched by the punching member 60, and the drive motor 70 is reversed in this state. As a result, the pushing cam drive shaft 91 is rotated in the counterclockwise direction, and the pushing cam 85 is rotated in the same direction (S7). The rotation of the pushing cam 85 causes the pushing lever 82 to press down the waste pushing member 80. Thereafter, upon detection of a flag indicating the pushing position of the pushing cam 85 by the sensor Sen3, the waste pushing member 80 is pushed from the hollow portion of the punching member 60 as illustrated in FIG. 6C (S8). Then, the reverse rotation of the drive motor 70 is stopped (S9), with the result that the punching waste is pushed to the punching waste box and collected therein.

[Backward Stroke Operation of Punching Member and Waste Pushing Member]

After the waste pushing member 80 pushes/discharges the punching waste at the pushing position, the drive motor 70 is rotated in the counterclockwise direction as above (S10). Then, the waste pushing member 80 starts being returned to the housing portion in the hollow portion of the punching member 60 by returning force of the pushing lever spring 89 of the waste pushing member 80 (S11). Thereafter, the pushing cam 85 is stopped, and the waste pushing member 80 is returned to the initial position, i.e., housing position, followed by stop of the drive of the drive motor 70.

The hollow punching member 60 surrounding an outer periphery of the waste pushing member 80 serves as a slide guide, so that even if the punching waste is adhered to the pushing member tip end 80*a* during the returning of the waste pushing member 80, the punching waste may be guided by the punching member 60 during the returning to be collected in the punching waste box, thereby reducing occurrence of scattering of the punching waste on the center-folded sheet bundle conveying path PB.

After returning of the waste pushing member 80 to the initial position (housing position), the drive motor 70 is rotated normally in the clockwise direction. Then, the punching cam 66 is also rotated in the clockwise direction. As a result, the punching member 60 is returned to the initial position (retreat position). Upon returning of the punching member 60, the drive motor 70 is stopped to prepare for the subsequent operation.

Subsequently, presence/absence of the next folded sheet bundle is confirmed as one job (S16). When there is the next folded sheet bundle, a processing flow returns to S1 of FIG. 8 where it is confirmed whether or not the folded sheet bundle is situated at the predetermined position, and a series of above-described operations are repeated until the number of sets of the sheet bundle reaches a value specified as one job. When the number of sets of the folded sheet bundle reaches the specified value, the processing flow proceeds to the next step. Then, particularly, it is confirmed whether or not an instruction of the "manual waste pushing" is issued from the operator (S17). When the manual waste pushing operation has never been performed, the punching member 60 is once moved to the punching position so as to perform the punching waste pushing operation of the pushing member 80 irrespective of whether or not there is a folded sheet bundle on the placement table (S5). Thereafter, the waste pushing member 80 is moved to the pushing position (S9) and then to the housing position (S12). Thereafter, the punching member 60 is returned to the retreat position (S15). With the above operation, the hollow punching member 60 forms the slide guide between itself and punching die 55 formed in the placement table 53. Thus, even if the punching waste exists in the hollow portion of the punching member 60, the punching waste is reliably made to fall into the punching waste box 52 to be collected therein.

[Intermittent Pushing of Punching Waste Pushing Member]

Subsequently, in step S6 of the flowchart of FIG. 8, when, separately from the determinations concerning the sheet attribute information, i.e., determinations of whether or not the number of sheets is larger than a predetermined value and whether or not the thickness is larger than a predetermined value, "NO" is determined, conversely to the above, in any of the determinations of whether or not the punching operation has been performed three times without the punching waste pushing operation, whether or not a current sheet bundle is the final sheet bundle in the job, and whether or not an instruction of the manual waste pushing operation has been issued, the punching member 60 is returned to the retreat position without operation of the waste pushing member 80, and then the punching member 60 is moved to the punching position once again.

An advantage of this operation will be described using FIGS. 10A and 10B. FIGS. 10A and 10B each illustrate a case where eight sets of a folded sheet bundle composed of six sheets in a folded state (obtained by folding three sheets) are punched. FIG. 10A illustrates a case where the waste pushing member 80 is moved from the housing position to a discharging position which is the pushing position during movement of the punching member 60 from the retreat position to punching position for each of eight sets of the sheet bundle. That is, eight reciprocating movements of the waste pushing member 80 are made for eight reciprocating movements of the punching member 60.

On the other hand, FIG. 10B illustrates a case where the pushing operation of the waste pushing member 80 is performed once for three punching operations of the punching member 60. This reduces the number of times of the pushing operations by storing the punching waste generated by three punching operations in the waste residual range 60*b* illustrated in FIG. 5B. Thus, it can be understood that processing of 10B is completed earlier than processing of FIG. 10A by a time length corresponding to two punching operations. This is due to a reduction in a time required for the punching member 60 to reciprocate between the punching position and retreat position. While the eight sets of the folded bundle are used in this example, the larger the number of sets of the sheet bundle to be processed, the larger a difference in processing speed becomes. Thus, the processing speed can be increased by the intermittent pushing operation of the waste pushing member 80 illustrated in FIG. 10B.

In the present invention, the sheet attribute information refers to information concerning the sheet, such as the number of the sheets, a thickness of the sheets, a material of the sheet, that influences on the punching processing. In the above description, whether the number of sheets as the sheet attribute information is equal to or smaller than a predetermined value or exceeds the predetermined value is used as a reference. However, separately from the above, whether or not a thickness of a folded sheet bundle exceeds a predetermined value may be used as a reference. Alternatively, a threshold value used to determine whether a thickness of one sheet is large or small may be set, and a value obtained by multiplying the threshold value by the number of sheets may be as the sheet attribute information. In this case, it may be determined whether to perform the pushing operation for each punching operation or to perform the pushing operation intermittently based on a comparison with a set reference value.

Further, in the above description, a gap exists between the folded sheet bundle placed on the placement table 53 and the unit base 56 supporting the punching member 60 and the waste pushing member 80, as illustrated in FIGS. 6A to 6C and 7A to 7C. However, before the punching operation is performed, the entire unit base 56 may be moved to the placement table 53 side to press-hold the folded sheet bundle between the placement table 53 and the unit base 56 for punching and subsequent pushing operation. Even in this case, the pushing member 80 is moved to the pushing position after completion of the punching operation and is returned to the housing portion of the hollow portion of the punching member 60 before returning of the punching member 60, so that the punching waste is not stopped by a sheet punching blade cross section or is not impeded from falling, but can smoothly fall into the punching waste box.

[Control Configuration]

Figure 11:
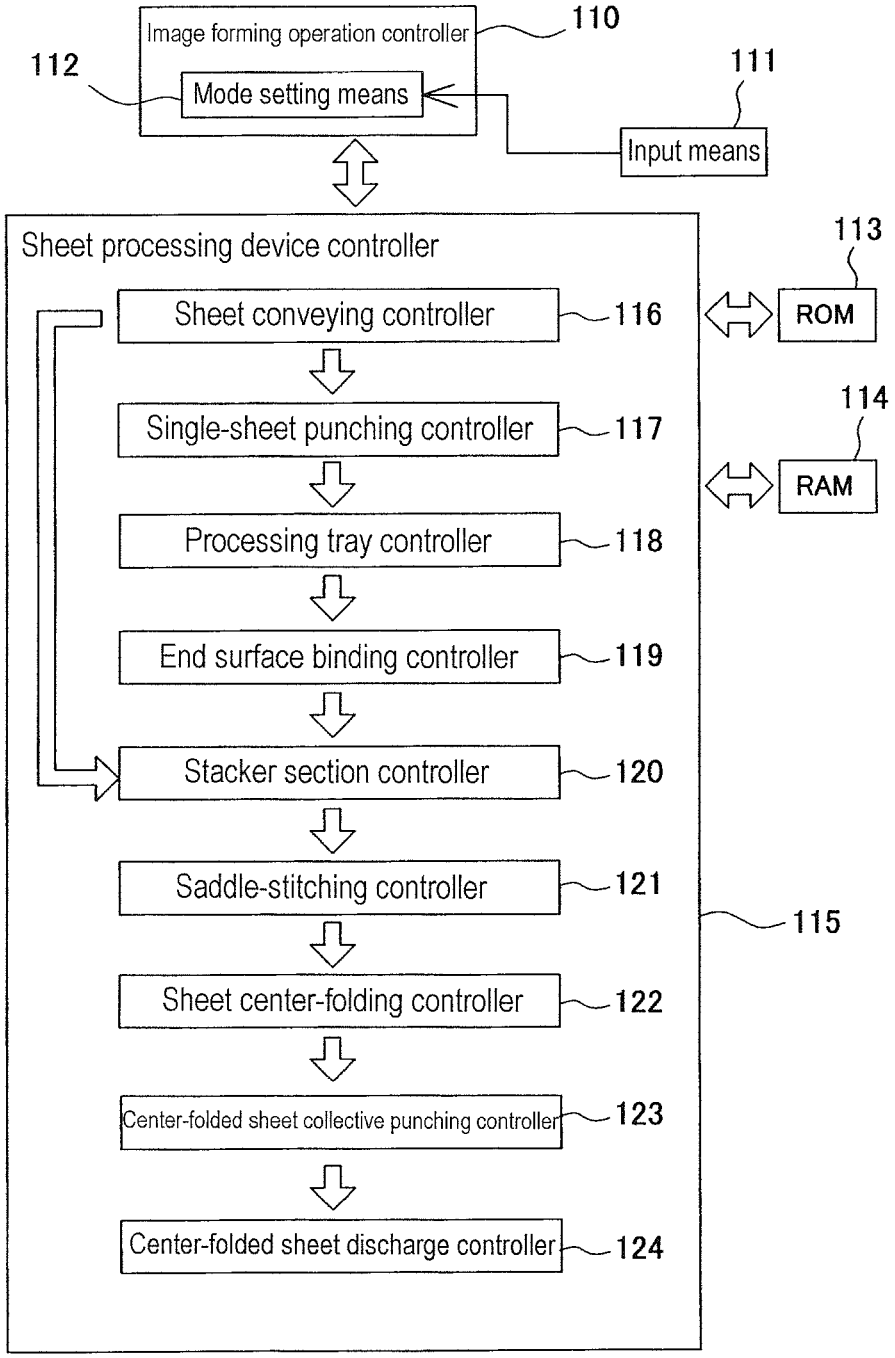
FIG. 11 is a view illustrating a control configuration of the sheet processing device of FIG. 2.

The following describes configurations of the sheet processing device B provided with the above-described sheet punching device 50 and the image forming device A including the sheet processing device B with reference to a block diagram of FIG. 11. The image forming device controller 110 provided with an image forming unit receives an input of desired processing through an input means 111 provided in a control panel. This input controls the sheet processing device controller 115 of the sheet processing device B through the mode setting means.

As described above, the processing mode of the sheet processing device B of the embodiment includes (1) "printout mode"; (2) "staple-binding mode"; (3) "sheet bundle saddle stitching and folding mode"; and (4) "center-folded sheet bundle collective punching mode".

Further, in the above "center-folded sheet bundle collective punching mode", it is possible to select whether to execute the waste pushing operation for each sheet bundle to be punched or intermittently in accordance with the sheet attribute information such as the number of sheets or a thickness of the sheet bundle. Further, a setting of "manual waste pushing" in which the waste is forcibly pushed in a final processing stage according to an instruction from an operator is also available. This "manual waste pushing" may be instructed directly to the sheet processing device controller 115 by means of a button switch or the like.

The sheet processing device B includes the sheet processing device controller 115 that operates according to the selected mode, a ROM that stores an operation program, and a RAM that stores control data. The sheet processing device controller 115 includes a sheet conveying controller 116 that controls sheet conveyance in the device, a single-sheet punching controller 117 that performs punching processing for each sheet using the single-sheet punching unit 28, a processing tray controller 118 that controls stacking control of the sheets to be stacked on the processing tray 29, and an end surface binding controller 119 that binds an end surface side of the sheets stacked in a bundle state on the processing tray 29 and discharges the bound sheet bundle.

In a case where the sheet bundle is saddle-stitched or center-folded at about a ½ position thereof in the sheet conveying direction, control is performed by a stacker section controller 120 that stacks the sheet bundle in the stacker section 35. The stacker section controller 120 generates a sheet bundle aligned by the stopper 38 for regulating a leading end of the sheets carried one by one in the stacker section 35 or by a not illustrated sheet side edge alignment member. The sheet processing device controller 115 further includes a saddle-stitching controller 121 that controls the saddle-stitching stapler to drive the staple into near the center of the sheet bundle and a sheet center-folding controller 122 that controls the folding blade 46 to push the saddle-stitched sheet bundle into the folding roller 45 for center folding.

The sheet processing device controller 115 further includes a center-folded sheet collective punching controller 123 that controls the sheet punching device 50 according to the above-described "center-folded sheet bundle collective punching mode" or "manual waste pushing". Thereafter, the center-folded sheet bundle that has been subjected to the collective punching is discharged to and stacked on the second sheet discharge tray under control of a center-folded sheet discharge controller 124 that controls the folding roller 45 functioning also as a bundle conveying roller and a bundle discharge roller 49.

The center-folded collective punching control especially related to the present invention has been described in the descriptions of respective mechanisms and with reference to the operation state diagrams and flowcharts of FIGS. 6A to 6C to FIG. 9, so the descriptions thereof will be omitted here, and the sheet punching device 50 is controlled according to the descriptive contents.

According to the preferred embodiment for practicing the present invention, the following advantages can be obtained.

1. According to the above-described embodiment, there is provided a sheet punching device that applies punching processing to a sheet, the device including a placement table 53 on which the sheet is placed, a hollow punching member 60 that punches the sheet placed on the placement table 53, a punching moving member 66 that moves the punching member between a punching position where the sheet is punched and a retreat position retreated from the punching position, a punching drive section 70 that drives the punching moving member 66, a waste pushing member 80 that is disposed in the hollow portion of the punching member 60 and pushes punching waste remaining in the hollow portion, a pushing moving member 85 that moves the waste pushing member 80 between a pushing position protruding from the hollow portion of the punching member and a housing position in the hollow portion, and a pushing drive section 70 that drives the pushing moving member 85.

With the above configuration, movement of the punching member 60 between the punching position where the sheet is punched and the retreat position retreated from the punching position and movement of the waste pushing member 80 between the pushing position where the waste remaining in the hollow portion is pushed and the housing position in the hollow portion can be operated independently. Thus, power required to punch the sheet can be saved, the punching waste can be reliably pushed and discharged from inside the punching member, and quality of a punch hole shape can be maintained.

2. Further, according to the above-described embodiment, in the sheet punching device of the above 1, the punching moving member 66 is driven by the punching drive section 70 to move the punching member 60 to the punching position for punching of the sheet, followed by activation of the pushing drive section 70 to drive the pushing moving member 85 to move the waste pushing member 80 to the pushing position.

With this configuration, the sheet is punched by the hollow punching member 60 and, thereafter, the punching waste is pushed by the waste pushing member 80, so that the pushing member does not press the sheet during the punching operation, thereby allowing further saving of power required for the punching operation and reducing a break of the sheet at the punched portion during the punching operation. Further, the punching waste is smoothly pushed by being guided inside the punching member.

3. Further, according to the above-described embodiment, in the sheet punching device of the above 2, the waste pushing member 80 pushes the punching waste from the punching member 60, and then the pushing moving member 85 is driven to return the waste pushing member 80 to the housing position in the hollow portion, followed by drive of the punching moving member 66 to move the punching member to the retreat position.

With the above configuration, in the returning operation to the initial positions (housing position and retreat position) of the waste pushing member 80 and punching member 60, the waste pushing member 80 is returned to the housing position, and then the punching member 60 is returned to the retreat position, so that the hollow portion guides the returning of the waste pushing member, whereby the waste pushing member 80 can be returned smoothly to the housing position.

4. Further, according to the above-described embodiment, in the sheet punching device of the above 3, the punching moving member 66 and the pushing moving member 85 are each constituted by an eccentric cam.

With this configuration, the punching member 60 and the waste pushing member 80 can each be made to reciprocate with a simple configuration.

5. Further, according to the above-described embodiment, in the sheet punching device of the above 4, the punching drive section 70 and pushing drive section 70 are realized as a single common drive motor 70, and whether the eccentric cam is rotated as the punching moving member 66 or the pushing moving member 85 is switched depending on a rotation direction of the drive motor 70.

With this configuration, whether to move the punching member 60 or the waste pushing member 80 can be selected by switching the rotation direction of the single drive motor 70 serving as a drive source, so that it is not necessary to provide a plurality of drive sources in order to move the punching member 60 and the waste pushing member 80 independently of each other. This can reduce device cost.

6. Further, according to the above-described embodiment, there is provided a sheet punching device that applies punching processing to a conveyed sheet, the device including a placement table 53 on which the sheet is placed, a hollow punching member 60 that punches the sheet placed on the placement table 53, a punching moving member 66 that moves the punching member 60 between a punching position where the sheet is punched and a retreat position retreated from the punching position, a punching drive section 70 that drives the punching moving member 66, a waste pushing member 80 that is disposed in the hollow portion of the punching member 60 and pushes punching waste remaining in the hollow portion, a pushing moving member 85 that moves the waste pushing member 80 between a pushing position protruding from the hollow portion of the punching member and a housing position in the hollow portion, a pushing drive section 70 that drives the pushing moving member 85, and a punching controller 123 that controls the punching drive section 70 and pushing drive section 70, wherein the punching controller 123 controls, according to attribute information of a sheet placed on the placement table 53, whether a waste pushing operation of the waste pushing member 80 is performed for each punching operation or intermittently.

With the above configuration, movement of the punching member 60 between the punching position where the sheet is punched and the retreat position retreated from the punching position and movement of the waste pushing member 80 between the pushing position where the waste remaining in the hollow portion is pushed and the housing position in the hollow portion can be operated independently. Further, whether the waste pushing operation is performed for each punching operation or intermittently is controlled according to the sheet attribute information. Thus, the punching operation and pushing operation of the punching waste generated during the punching operation can be effectively performed.

7. Further, according to the above-described embodiment, in the sheet punching device of the above 6, the punching controller 123 controls the waste pushing member 80 to intermittently push the punching waste from the punching member 60 after a predetermined number of times of the punching operations when the number of sheets placed on the placement table 53 as the sheet attribute information is equal to or smaller than a predetermined value or when a thickness of the sheets placed as the sheet attribute information is equal to or smaller than a predetermined value, while controls the waste pushing member 80 to push the punching waste for each punching operation of the punching member 60 when the number of sheets as the sheet attribute information exceeds the predetermined value or when the thickness of the sheets as the sheet attribute information exceeds the predetermined value.

With this configuration, when the number of the sheets or thickness of the sheets is equal to or smaller than the predetermined value, an amount of the punching waste remaining in the punching member 60 is not so large, so that the waste pushing member 80 is controlled to push the punching waste intermittently after a certain amount of the pushing waste is stored; while when the number of the sheets or thickness of the sheets exceeds the predetermined value, the pushing operation is performed for each punching operation of the punching member 60. Thus, punching performance is enhanced particularly when the number of the sheets or thickness of the sheets is equal to or smaller than the predetermined value.

8. Further, according to the above-described embodiment, in the sheet punching device of the above 6, the punching drive section and pushing drive section are realized as a single common drive motor 70, and the punching controller 123 switches, depending on a rotation direction of the drive motor 70, whether to drive the punching moving member 66 to move the punching member 60 or drive the pushing moving member 85 to move the waste pushing member 80.

With this configuration, whether to move the punching member 60 or the waste pushing member 80 can be selected by switching the rotation direction of the single drive motor 70 serving as a drive source, so that it is not necessary to provide a plurality of drive sources. This can reduce device cost.

9. Further, according to the above-described embodiment, in the sheet punching device of the above 7, when determining that a sheet placed on the placement table is a last sheet, the punching controller 123 drives the pushing moving member to perform the pushing operation even in a case where the pushing operation is set so as not to be performed based on a determination that the number of sheets or thickness of the sheets is equal to or smaller than the predetermined value.

With this configuration, when it is determined that the sheet placed on the placement table is a last sheet in one job, the punching waste pushing operation is performed even in a case where the pushing operation is set so as to be performed intermittently with respect to the punching operation based on a determination that the number of sheets or thickness of the sheets is equal to or smaller than the predetermined value. This eliminates the need to make a special initial setting for a subsequent job, thereby effectively performing the punching operation.

10. Further, according to the above-described embodiment, in the sheet punching device of the above 7, when manual waste pushing is instructed, the punching controller drives, after completion of the sheet punching operation of the punching member, the pushing moving member in a state where the punching member is situated at the punching position to perform the pushing operation and, thereafter, returns the punching member to the retreat position.

With this configuration, when the manual waste pushing is instructed, the punching member is previously moved to the punching position, and then the waste pushing member is activated. Thus, even if the punching waste remains in the punching member, discharged waste is not scattered.

11. According to the above-described embodiment, there is provided a sheet processing device including a stacker section 35 that stacks sheets as a sheet bundle, a folding section that includes a folding roller 45 that applies folding processing to the stacked sheets, and the sheet punching device described in the above 1 which is disposed downstream of the folding section.

With this configuration, the same effects as those described in the above 1 can be obtained.

12. According to the above-described embodiment, there is provided an image forming device including an image forming section 2 that forms an image onto sequentially conveyed sheets and a sheet processing device B that applies predetermined processing to the sheets conveyed from the image forming section 2, wherein the sheet processing device B includes the sheet punching device 50 described in the above 1.

With this configuration, the same effects as those described in the above 1 can be obtained.

In the description of the effects of the embodiment, reference numerals are given to constituent elements recited in the claims so as to clarify a correspondence relationship between the description of "Detailed Description" and the description of "What is Claimed is".

Further, it should be appreciated that the present invention is not limited to the present embodiment, and various modifications may be made thereto. Further, all technical matters included in the technical ideas set forth in the claims should be covered by the present invention. While the invention has been described based on a preferred embodiment, those skilled in the art can realize various substitutions, corrections, modifications, or improvements may be made from the content disclosed in the specification by a person skilled in the art, which are included in the scope defined by the appended claims.

This application is based upon and claims the benefit of priority from prior Japanese Patent Applications No. 2014-093238 and No. 2014-093239, both filed Apr. 29, 2014, the entire contents of which are incorporated herein by reference.

What is claimed is:

1. A sheet punching device that applies punching processing to a sheet, comprising:

a placement table on which the sheet is placed;

a hollow punching member that punches the sheet placed on the placement table;

a punching moving member that moves the punching member between a punching position where the sheet is punched and a retreat position retreated from the punching position;

a punching drive section that drives the punching moving member;

a waste pushing member that is disposed in the hollow portion of the punching member and pushes punching waste remaining in the hollow portion;

a pushing moving member that moves the waste pushing member between a pushing position protruding from the hollow portion of the punching member and a housing position in the hollow portion; and a pushing drive section that drives the pushing moving member, wherein the punching drive section and the pushing drive section are realized as a single common drive motor, and a rotational direction of the drive motor is switched to select the punching moving member to move the hollow punching member or the pushing moving member to move the waste pushing member.

2. The sheet punching device according to claim 1, wherein the drive motor rotates in one rotational direction to drive the punching moving member to move the punching member to the punching position for punching of the sheet, followed by activation of the pushing drive section to drive the pushing moving member to move the waste pushing member to the pushing position.

3. The sheet punching device according to claim 2, wherein the drive motor rotates in another rotational direction to drive the waste pushing member to push the punching waste from the punching member, and then drive the pushing moving member to return the waste pushing member to the housing position in the hollow portion, followed by drive of the punching moving member to move the punching member to the retreat position.

4. The sheet punching device according to claim 3, wherein the punching moving member and the pushing moving member are each constituted by an eccentric cam.

5. A sheet processing device comprising:

a stacker section that stacks sheets as a sheet bundle;

a folding section that includes a folding roller that applies folding processing to the stacked sheets; and the sheet punching device as claimed in claim 1 which is disposed downstream of the folding section.

6. An image forming device comprising:

an image forming section that forms an image onto sequentially conveyed sheets; and a sheet processing device that applies predetermined processing to the sheets conveyed from the image forming section, wherein the sheet processing device includes the sheet punching device as claimed in claim 1.

7. A sheet punching device that applies punching processing to a conveyed sheet, comprising:

a placement table on which the sheet is placed;

a hollow punching member that punches the sheet placed on the placement table;

a punching moving member that moves the punching member between a punching position where the sheet is punched and a retreat position retreated from the punching position;

a punching drive section that drives the punching moving member;

a waste pushing member that is disposed in the hollow portion of the punching member and pushes punching waste remaining in the hollow portion;

a pushing moving member that moves the waste pushing member between a pushing position protruding from the hollow portion of the punching member and a housing position in the hollow portion;

a pushing drive section that drives the pushing moving member; and a punching controller that controls the punching drive section and the pushing drive section, wherein the punching controller controls, according to attribute information of a sheet placed on the placement table, whether a waste pushing operation of the waste pushing member is performed for each punching operation or intermittently.

8. The sheet punching device according to claim 7, wherein the punching controller controls the waste pushing member to intermittently push the punching waste from the punching member after a predetermined number of times of the punching operations when the number of sheets placed on the placement table as the sheet attribute information is equal to or smaller than a predetermined value or when a thickness of the sheets placed as the sheet attribute information is equal to or smaller than a predetermined value, while controls the waste pushing member to push the punching waste for each punching operation of the punching member when the number of sheets as the sheet attribute information exceeds the predetermined value or when the thickness of the sheets as the sheet attribute information exceeds the predetermined value.

9. The sheet punching device according to claim 8, wherein when determining that a sheet placed on the placement table is a last sheet, the punching controller drives the pushing moving member to perform the pushing operation even in a case where the pushing operation is set so as not to be performed based on a determination that the number of sheets or thickness of the sheets is equal to or smaller than the predetermined value.

10. The sheet punching device according to claim 8, wherein the punching controller is set to receive an instruction of a manual waste pushing to manually control the waste pushing operation so that when the manual waste pushing is instructed, the punching controller drives, after completion of the sheet punching operation of the punching member, the pushing moving member in a state where the punching member is situated at the punching position to perform the pushing operation and, thereafter, returns the punching member to the retreat position.

11. The sheet punching device according to claim 7, wherein the punching drive section and pushing drive section are realized as a single common drive motor, and the punching controller switches, depending on a rotation direction of the drive motor, whether to drive the punching moving member to move the punching member or drive the pushing moving member to move the waste pushing member.

* * * * *